United States Patent [19]

Valentini et al.

[11] Patent Number: 4,785,858

[45] Date of Patent: Nov. 22, 1988

[54] DEVICE FOR FIRMLY LOCKING A SYRINGE ON A BODY WHICH MAY BE COUPLED THERETO

[75] Inventors: Luigi Valentini, Milan; Mario Coccia, Cesano Boscone, both of Italy

[73] Assignee: Farmitalia Carlo Erba S.p.A., Milan, Italy

[21] Appl. No.: 75,683

[22] Filed: Jul. 20, 1987

[30] Foreign Application Priority Data

Jul. 25, 1986 [IT] Italy ..... 22648/86[U]

[51] Int. Cl.[4] ..... B65B 3/02

[52] U.S. Cl. ..... 141/27; 141/329; 141/384; 285/92; 604/905; 604/415

[58] Field of Search ..... 141/24–28, 141/311, 312, 319, 329, 330, 346, 368, 369, 370, 371, 372, 375, 382, 383, 384, 385, 386; 285/97, 82, 87; 604/403, 411, 414, 415, 905, 240, 242, 201

[56] References Cited

U.S. PATENT DOCUMENTS

| | | | |
|---|---|---|---|
| 2,828,742 | 4/1958 | Ashkenaz | 604/242 X |
| 3,144,866 | 8/1964 | Ellis | 285/92 X |
| 3,992,044 | 11/1976 | Muslin | 285/92 |
| 3,993,063 | 11/1976 | Larrabee | 604/414 X |
| 4,253,501 | 3/1981 | Ogle | 141/27 |
| 4,452,473 | 6/1984 | Ruschke | 604/905 X |
| 4,564,054 | 1/1986 | Gustavsson | 141/329 |
| 4,576,211 | 3/1986 | Valentini et al. | 141/329 |
| 4,601,703 | 7/1986 | Herlitze | 604/415 X |
| 4,607,671 | 8/1986 | Aalto et al. | 141/329 |
| 4,619,651 | 10/1986 | Kopfer et al. | 604/415 |

FOREIGN PATENT DOCUMENTS

| | | | |
|---|---|---|---|
| 99293 | 1/1984 | European Pat. Off. | 285/92 |

*Primary Examiner*—Henry J. Recla
*Assistant Examiner*—Ernest G. Cusick
*Attorney, Agent, or Firm*—Oblon, Fisher, Spivak, McClelland & Maier

[57] ABSTRACT

A body is provided with members for coupling it to one end of a bottle or the like. The body has a seat for housing the free end of a syringe, with a hole for allowing for the syringe needle to pass through. The free end of a syringe may be housed and threaded in the seat. On the side opposite surfaces of the body seat and at the syringe end provided for insertion in the seat, there are formed radially projecting longitudinal teeth and slanted resilient fins which are deflected by the teeth as the syringe is threaded to the body. The teeth abut against the fins, thereby preventing the syringe from being screwed off the body.

6 Claims, 1 Drawing Sheet

DEVICE FOR FIRMLY LOCKING A SYRINGE ON A BODY WHICH MAY BE COUPLED THERETO

FIELD OF THE INVENTION

The present invention relates to a device for locking, in a firm and not reversible way, a syringe on a body to which the syringe is coupled.

BACKGROUND OF THE INVENTION

As is known, syringes are provided with a needle for withdrawing from or injecting into a bottle or the like, or a shaped end of a small sucking or discharging tube, a liquid, generally provided with pharmacological properties. To that end, the syringe may be in a free condition and freely coupled to a bottle, or it may be mounted on an apparatus having a latching member at the bottle mouth. Such an apparatus, comprising a sealed chamber in which the needle is usually housed and from which the needle may exit only when the apparatus is firmly mounted on the mouth of a bottle or the like, is disclosed and illustrated in U.S. Pat. No. 4,576,211.

For some applications and cases it may be dangerous or undesirable to allow the syringe to disengage from the body in which it has been coupled. For example, it would be dangerous to detach the syringe from the apparatus disclosed in the above mentioned U.S. patent, or to remove it from the shaped end of an intravenous injection small tube, into which a very dangerous pharmaceutical substance, such as a cytostatic drug, may be injected by the syringe.

OBJECT OF THE INVENTION

Thus, the main object of the present invention is to provide such a device adapted for preventing a syringe from being disengaged from a body into which the syringe has been coupled.

SUMMARY OF THE INVENTION

According to one aspect of the present invention, the above and other objects are achieved by a device comprising a body provided with members for coupling it to the end of a bottle or the like or of a small tube. The body has a seat for housing the free end of a syringe. A hole allowing for the syringe needle to pass through is formed in the seat. The free end of a syringe may be housed in the seat with the syringe needle extending through the hole. In the body seat and on the syringe complementary and cooperating threads are formed for threadedly coupling the syringe the body. On the opposite side surfaces of the body, at the seat, and on the end of the syringe to be inserted into the seat, or vice versa, there are provided radially projecting longitudinal teeth and slanted resilient fins. The fins are deflected by the teeth as the syringe is threaded on the body. The teeth abut against the said fins so as to prevent the syringe from being screwed off the body.

BRIEF DESCRIPTION OF THE DRAWINGS

For better understanding the structure and characteristics of the device according to the invention, a preferred embodiment thereof will be disclosed hereinafter, with reference to the accompanying drawing.

DESCRIPTION OF THE PREFERRED EMBODIMENT

Figure 1:
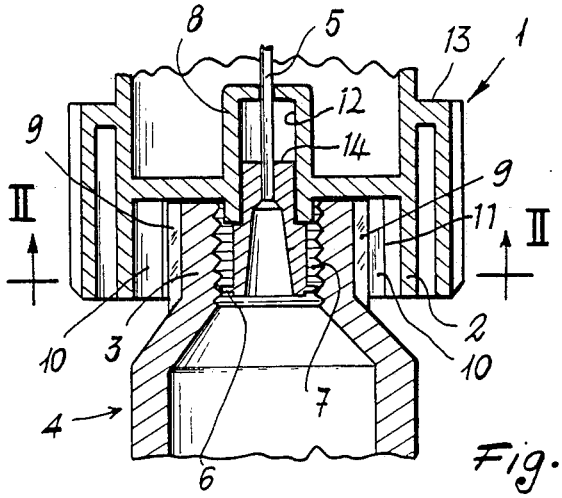
FIG. 1 schematically shows an axial longitudinal cross-section of the device, with its parts in an assembled condition.

The device illustrated in the drawing comprises a body 1 which is provided with members (which have not be shown for simplicity and since they may be made in different ways) for fixing it on the mouth of a drug holding bottle or the like. In the illustrated embodiment, the body 1 comprises a major part 13 and a minor part 14 in the form of a sleeve press fit into the major part 13. A tubular cylindrical wall 2 defines a seat 11 in which the free end (or "the working end") 3 of a syringe 4 having a syringe needle 5 may be housed. The syringe needle 5 extends through a hole 12 formed at the center of the seat 11.

In the embodiment being disclosed, the body 1 (an end portion of which is shown in the drawings) consists of an apparatus like that disclosed in U.S. Pat. No. 4,576,211. As is disclosed in detail in that patent, the body 1 is adapted for connecting, under safe conditions, a drug holding bottle to a syringe from the minor part 14 of the body 1 is firmly locked in the body 1 and a collar 6 projects therefrom werewith the free end 3 in the radially inwardly facing surface of the working end of the syringe 4 inside the free end 3.

It should be apparent that the body 1 may be different from the body of the mentioned U.S. patent. For example, the body 1 may be provided with a tubular cylindrical wall extending on an opposite side to the wall 2 and which may be screw engaged on or forced onto the mouth of a bottle or the like. Alternatively, on a lug 8 of the body 1 the free end of a small tube may simply be fitted, and on the other end of the small tube, an epicranial needle may be mounted for carrying out venous transfusions.

Figure 2:
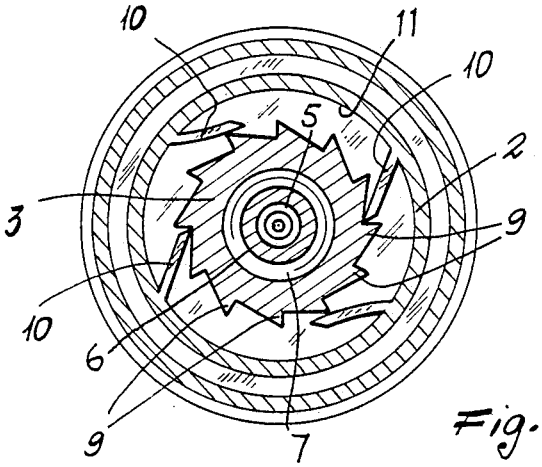
FIG. 2 is a cross-sectional view of the device taken along the line II—II of FIG. 1.

As shown in the drawings, on the outer surface of the free end 3 there is formed a tooth arrangement consisting of a continuous plurality of teeth 9 which extend longitudinally and the surfaces of which are slanted as shown in FIG. 2.

From the inner surface of the tubular wall 2, resilient and slanted fins 10 project which cooperate with the teeth 9. As should be apparent, as the syringe 4 is threaded into the seat 11 of the body 1, the fins 10 will be deflected by the teeth 9, thereby allowing the syringe to freely rotate to be firmly coupled to the body 1. On the other hand, if, after having coupled the syringe to the body 1, one tries to disengage it, then the free ends of the fins 10 (or at least some of them) will abut against the teeth 9, thereby preventing the syringe 4 from being rotated in an anticlockwise direction (with respect to FIG. 2). In this way, the syringe 4 will be held firmly coupled to the body 1.

It should be apparent that the teeth 9 may be formed on the inner surface of the tubular wall 2 and that the fins 10 may project from the outer surface of the free end 3 to be inserted into the seat 11 of the body 1 with the same results achieved by the embodiment shown in the drawings.

We claim:

1. A device for transferring liquids, said device comprising:

(a) a syringe having a working end, the working end of said syringe having a radially inwardly facing surface and a radially outwardly facing surface;

(b) a syringe needle projecting from the working end of said syringe;

(c) a body having a seat sized, shaped, and positioned to receive the working end of said syringe;

(d) said seat having a radially inwardly facing surface, a radially outwardly facing surface, and a hole sized, shaped, and positioned to allow said syringe needle to pass therethrough;

(e) one of said radially inwardly facing surface and said radially outwardly facing surface of the working end of said syringe and said radially inwardly facing surface and said radially outwardly facing surface of said seat having threads for coupling said syringe to said body; and (f) the working end of said syringe and one of said radially inwardly facing surface and said radially outwardly facing surface of said seat having:

(i) complementary and cooperating teeth and (ii) slanted and resilient fins that permit the threading of the working end of said syringe into said seat but that permit the unthreading of the working end of said syringe from said seat.

2. A device as recited in claim 1 wherein:

(a) said threads on said syringe are internal threads formed on the working end of said syringe; and (b) said threads on said body are external threads formed on the radially outwardly facing surface of said seat.

3. A device as recited in claim 1 wherein:

(a) said teeth are formed on an external surface of said syringe and project outwardly from said syringe toward said seat; and (b) said slanted and resilient fins are formed in said radially inwardly facing surface of said seat and project inwardly toward said syringe.

4. A device as recited in claim 1 wherein:

(a) said body comprises a lug;

(b) said lug projects away from said seat;

(c) said syringe needle projects through said lug; and (d) a tube can be coupled on said lug.

5. A device as recited in claim 1 wherein:

(a) said body comprises a major part and a minor part in the form of a sleeve press fit into said major part and having a radially outwardly facing surface;

(b) a collar is formed on the radially outwardly facing surface of said minor part of said body;

(c) said threads for coupling said syringe to said body are located on said radially inwardly facing surface of the working end of said syringe; and (d) said collar on the radially outwardly facing surface of said minor part of said body engages said threads on said radially inwardly facing surface of the working end of said syringe.

6. A device as recited in claim 1 wherein said syringe needle is part of said body.

* * * * *